US005857873A

United States Patent [19]

Castaldo

[11] Patent Number: 5,857,873

[45] Date of Patent: Jan. 12, 1999

[54] ELECTRICAL JOINT ENVIRONMENTAL SEAL AND METHOD

[75] Inventor: Cosmo Castaldo, Westbury, N.Y.

[73] Assignee: Leviton Manufacturing Co., Inc., Little Neck, N.Y.

[21] Appl. No.: 978,924

[22] Filed: Nov. 26, 1997

Related U.S. Application Data

[62] Division of Ser. No. 799,179, Feb. 12, 1997, Pat. No. 5,711,066, which is a continuation of Ser. No. 442,857, May 17, 1995, abandoned, which is a continuation of Ser. No. 184,800, Jan. 21, 1994, abandoned.

[51] Int. Cl.[6] ..... H01R 13/40

[52] U.S. Cl. ..... 439/588; 439/281

[58] Field of Search ..... 439/281, 282, 439/367, 369, 521, 588

[56] References Cited

U.S. PATENT DOCUMENTS 3,120,987 2/1964 Degnan et al. ..... 439/588

4,063,793 12/1977 Judd ..... 439/588

5,259,782 11/1993 Giffin ..... 439/367

*Primary Examiner*—Neil Abrams

*Assistant Examiner*—Brian J. Biggi

*Attorney, Agent, or Firm*—Paul J. Sutton

[57] ABSTRACT

The present invention teaches a boot system for protecting plugs and connectors or receptacles for use in commercial and industrial environments or applications. A boot is provided for each of the plugs and connectors to be joined, with the boots being formed with triple-sealing cooperative surfaces which contact one another upon the boots being matingly joined. Each boot is further formed with stepped sealing means for receiving a cable to be wired to the device housed by the respective boot. Each boot is yet further formed with outer scalloped longitudinally extending surfaces adapted to receive the fingers of a user.

4 Claims, 4 Drawing Sheets

ELECTRICAL JOINT ENVIRONMENTAL SEAL AND METHOD

This is a division of application Ser. No. 08/799,179 filed on Feb. 12, 1997, now U.S. Pat. No. 5,711,066, which is a continuation of application Ser. No. 08/442,857 filed on May 17, 1995, which is a continuation of application Ser. No. 08/184,800 filed on Jan. 21,1994, the last two applications listed now abandoned.

BACKGROUND OF THE INVENTION

1. Field of the Invention

The invention is directed to the field of separable electrical connectors which can be joined to provide electrical circuits and more particularly to means and a method to provide an environmental seal about such separable connectors when joined to form an electrical joint.

2. Description of the Prior Art

According to present techniques when it is desired to protect an electrical joint, the components of such joint are placed in a weather proof housing with various seals for the housing components and cable entrances. Thus, the resulting joint may be much larger than required for the components joined. Alternatively, each of the components is provided with its required seal members and when two or more components are joined the resulting joint is larger than necessary since many sealing members are unnecessarily duplicated.

To reduce the size of the overall joint, an environmental seal can be cast or molded over the joint making separation of the joint components impossible and if joint repairs are necessary the seal and components must be separated from the respective cables and discarded.

SUMMARY OF THE INVENTION

The present invention overcomes the problems and deficiencies of the prior art by providing individual sealing means for each component which provides an environmental seal of the cable entry into the sealing means, and when two components are connected interlock so as to provide an environmental seal about the electrical joint which seal is only slightly larger than the components themselves. The environment seal takes the form of two boots each formed about a substantially central longitudinal axis of substantially resilient material such as natural rubber, synthetic rubber, elastomeric or the like, which can house a joint component such as a plug, connector or receptacle. Each of the boots is formed with a stepped sealing means for cooperatively receiving and engaging an insulated cable whose conductors are to be wired to one of the joint components. By following the installation method described herein, an environmental seal is created between such stepped sealing means and the insulated cable.

One of the boots is formed with exterior first, second and third outwardly facing sealing surfaces, while the second boot is formed with interior first and second inwardly facing sealing surfaces. The mating of the interior and exterior surfaces when the two boots are assembled providing an environmental seal about the two joined components.

The outer, cylindrical surfaces of the boots are formed with a plurality of scalloped recesses to make it easier to grip the boots during assembly and disassembly of the electrical joint and application to or removal from the individual components. It is an object of the instant invention to provide an improved environmental seal for the joint between two separable electrical components.

It is an object of the instant invention to provide an improved environmental seal for the components of an electrical joint comprised of mateable boots for each component which provides seals of the electrical cables entering each boot.

It is another object of the instant invention to provide an improved environmental seal for the components of an electrical joint comprised of mateable boots for each component which establish such environmental seal when mated.

It is still another object of the instant invention to provide an improved environmental seal for the components of an electrical joint comprised of mateable boots for each component, each of which provides a seal for the electrical cable entering the boot and when mated with the boot of an associated component forms an environmental seal about said electrical joint.

It is yet another object of this invention to form two mateable boots, each of which can receive a component of an electrical joint therein and form an environmental seal about such joint when assembled and having a surface configuration to facilitate handling such boots during joint assembly and disassembly.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
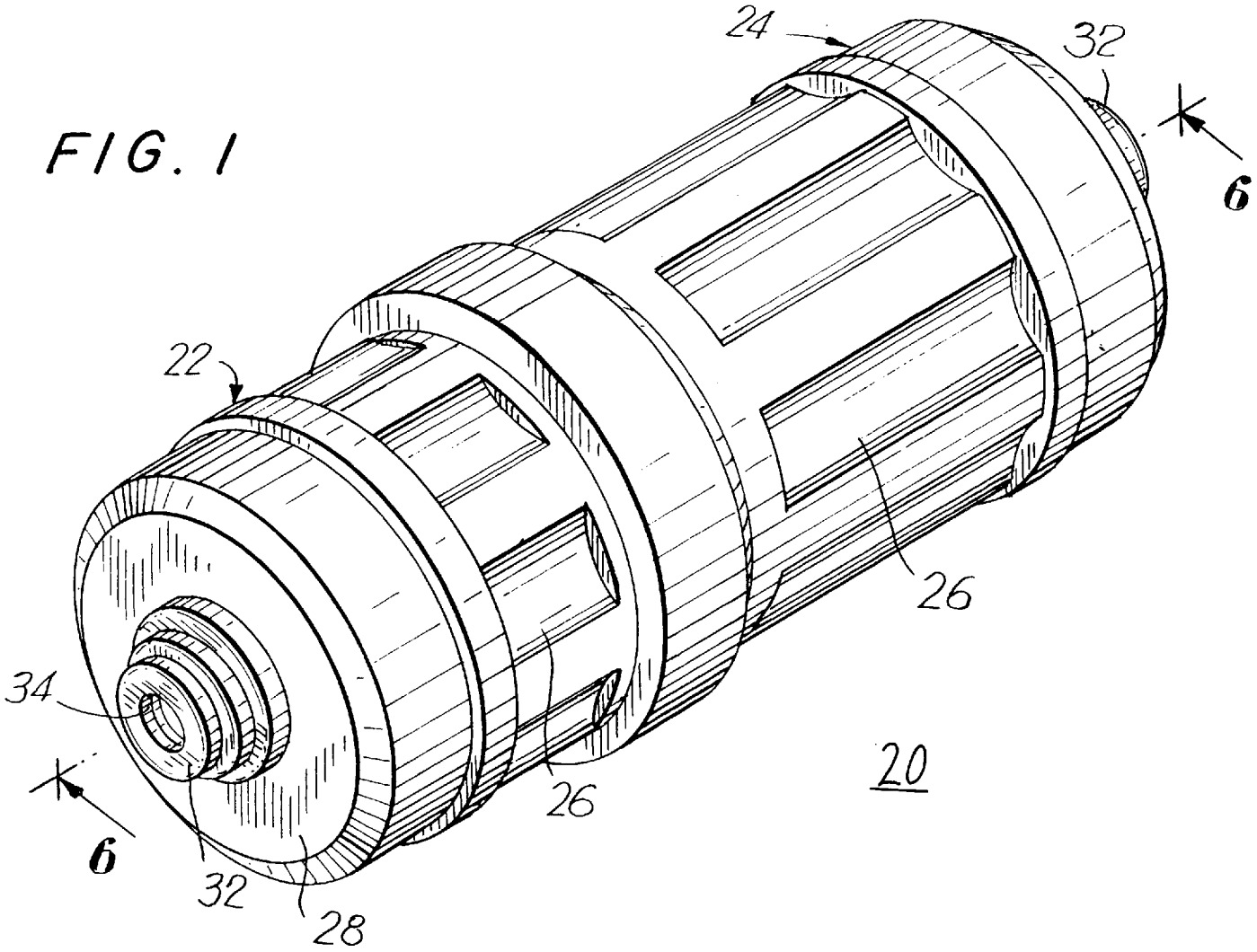
FIG. 1 is a top, right perspective view of a coupled boot design according to the concepts of the invention.
Figure 4:
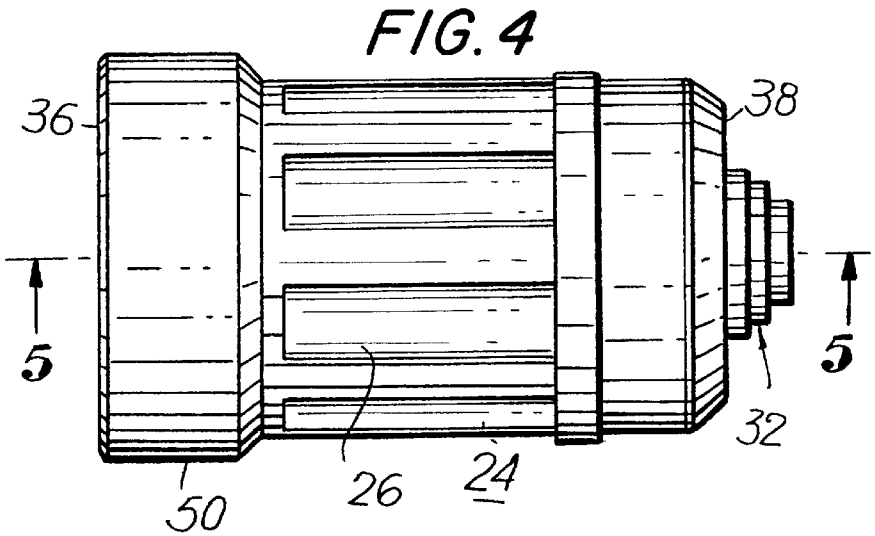
FIG. 4 is a side elevational view of the other of the two individual boots of FIG. 1.
Figure 5:
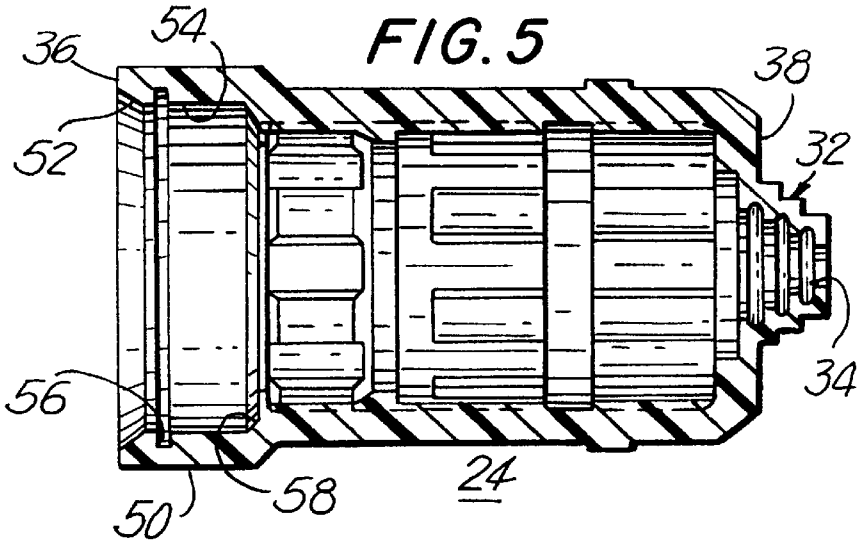
FIG. 5 is a side elevational view, in section, of the boot of FIG. 4 taken along the line 5—5.
Figure 2:
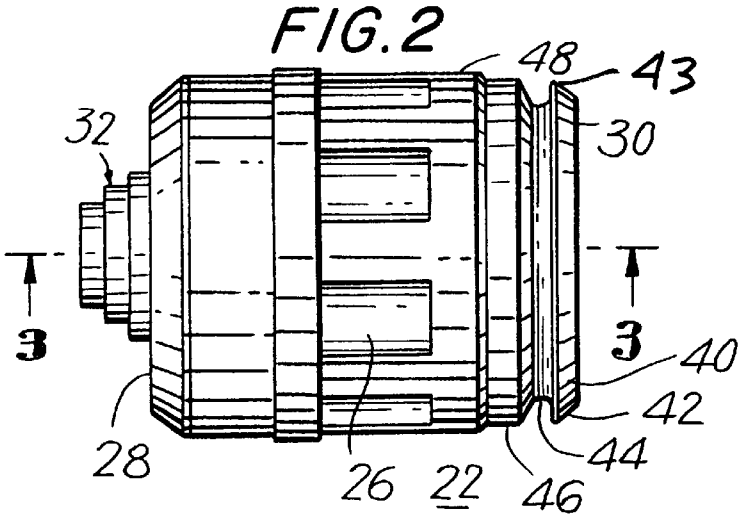
FIG. 2 is a side elevational view of one of the individual boots of FIG. 1.
Figure 3:
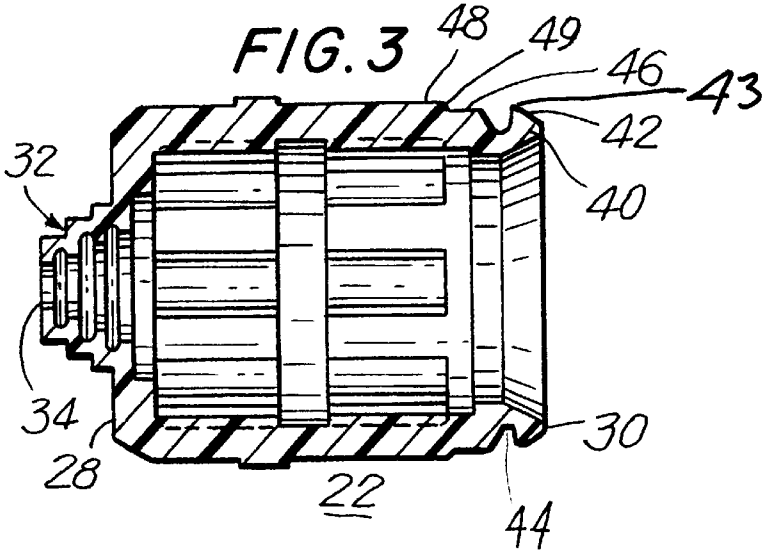
FIG. 3 is a side elevational view, in section, of the boot of FIG. 2 taken along the line 3—3.

Turning now to FIGS. 1, 2 and 4 there is shown an environmental seal assembly 20 composed of a boot 22 into which a plug assembly, for example, may be placed (not shown) and a boot 24 into which a receptacle assembly, for example, may be placed (not shown). Boots 22 and 24 are generally cylindrical with a series of scalloped recesses 26 placed along the entire periphery of boots 22, 24 extending in parallel with the longitudinal axis thereof for a portion of the boot length. These recesses 26 permit the boots 22, 24 to be easily grasped and manipulated for assembly and disassembly of the seal assembly 20.

At end 28 of boot 22 and end 38 of boot 24 are placed stepped sealing means 32 which provide a seal for the conductors (not shown) entering boots 22 and 24 through apertures 34 in stepped sealing means 32. At end 30 of boot 22 there is formed a flexible arm 40 having an outwardly facing surface 42. To the left of the section of reduced thickness 44, which creates flexible arm 40, are stepped sealing surfaces 46 and 48.

End 36 of boot 24 has a cuff 50 with a tapered entry as at 52 followed by a cylindrical sealing surface 54. Intermediate the tapered entry 52 and sealing surface 54 is an annular recess 56. The outside diameter of the flexible arm 40 at its tip 43 and surface 46 are greater than the inside diameter of sealing surface 54 and the outside diameter of surface 48 is greater than the inside diameter of entry 52. As a result, there is an interference fit between the respective mating surfaces, and because of the resiliency of the material from which the boots 22, 24 are fabricated, there is some compression and some expansion of the surfaces to permit relative movement between boots 22, 24. The intimate contact between the mating surfaces 46, 54 and 48, 52 results in a mutual scouring of these surfaces to remove dirt, grease, moisture and the like from these surfaces. Recess 56 provides a receptor for the materials removed from the surfaces so that they can not interfere with the desired intimate contact. In the same fashion, the section of reduced thickness 44 can also act as a receptor.

Figure 6:
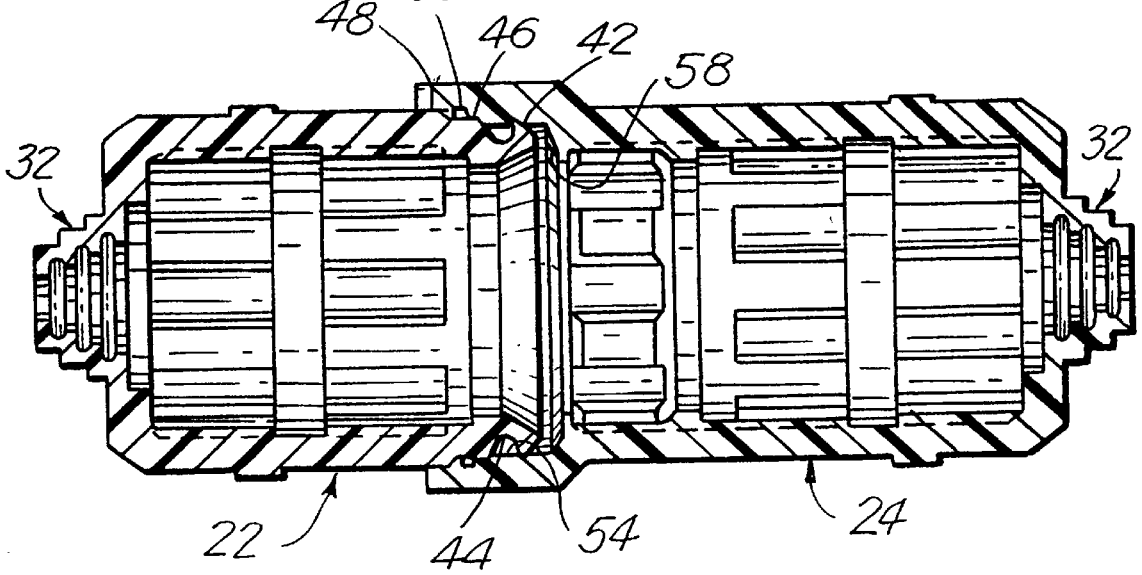
FIG. 6 is a side elevational view, in section, of the coupled boots of FIG. 1 taken along the line 6—6.

More particularly, as boot 22 is advanced into boot 24, as shown by FIG. 6, surfaces 42 and 46 of boot 22 and surface 52 of boot 24 scour each other and the material removed from the surfaces 42, 46 and 52 is deposited in recess 56. If desired, the cuff 72 of boot 70 (see FIG. 7) may be provided with two annular recesses 56 and 56'. As surfaces 74 and 46 of boot 22 traverses surface 52 of boot 70 any debris removed from these surfaces can be deposited in the recesses 56 and 56'.

Because of the intimate engagement of the various exterior surface of boot 22 with the interior surfaces of boot 24, a series of seals are provided between the boots 22, 24 thus providing an environmental seal for the electrical components therein. When fully seated, the outwardly facing surface 42 of flexible arm 40 of boot 22 engages the inwardly facing surface 58 adjacent surface 54 of boot 24 to provide a first or primary seal. Even if surfaces 42 and 58 do not fully engage, the tip 43 of flexible arm 40 engaging surface 54 will provide an excellent seal. The engagement between surface 46 of boot 22 and surface 54 of boot 24 provides a second seal. A third seal is provided by the engagement of inclined surface 49 between surfaces 46 and 48 and surface 48 all of boot 22 with entry surface 52 of boot 24.

Figure 7:
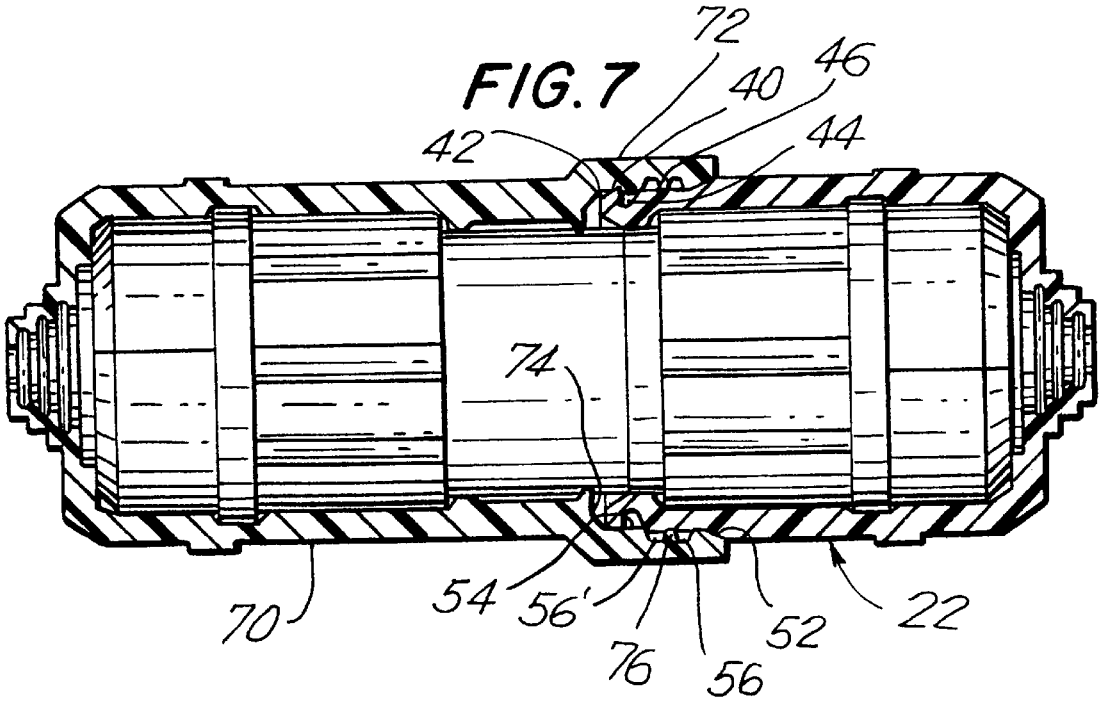
FIG. 7 is a side elevational view, in section, of a further coupled boot design according to the concepts of the invention.
Figure 8:
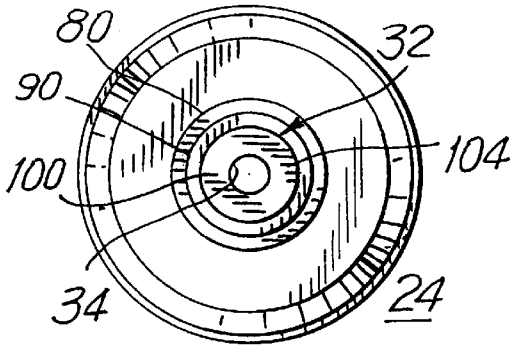
FIG. 8 is an end elevational view of each of the boots of FIG. 1.

In the case of the modified boot 70, of FIG. 7, four seals result from the mating of boots 70 and 22. The primary or first seal is established between outwardly facing surface 42 of arm 40 and inwardly facing surface 74 of boot 70. Again even if surfaces 42 and 74 do not fully engage, the tip 43 of arm 40 engaging surface 74 provides an excellent seal. This is due to the natural resiliency of the material from which boot 22 is fabricated and because of the elastic memory of the compressed part tending to restore the arm 40 to its original position and thus establish an intimate contact between the tip 43 of arm 40 and surface 74. The second seal is created between surface 46 of boot 22 and the portion of surface 54 of boot 70 to the left of recess 56'. A third seal is established between surface 46 of boot 22 and the rib 76 between recesses 56 and 56' of boot 70. The fourth seal results from the engagement of surfaces 48 and 49 of boot 22 with entry surface 52 of boot 70. These various seals, although in many cases redundant, do assure that the coupled boots 22 and 24 and 22 and 70 will prevent the entrance of dirt, grease, moisture or other debris into the electrical components and joint within such coupled boots.

The entry of the electrical cables into the various boots 22, 24 and 70 is sealed by the stepped sealing means 32, previously mentioned. Turning to FIGS. 8 to 11, the manner of providing the cable entry seal can be described. Stepped sealing means 32 has a first step ring 80 made up of riser 82 and tread 84, and an internal aperture 86, a second step ring 90 having a riser 92 and tread 94 and internal aperture 96 and a third step ring 100, with riser 102, tread 104 and an internal aperture 106 that communicates with aperture 34 to permit access to the interior of boot 24. Aperture 78 provides access to the interior of boot 24. Aperture 86 is displaced from and has a smaller diameter than aperture 78 resulting in a first grip ring 88. Aperture 96 is displaced from and of a smaller diameter than aperture 86 creating second grip ring 98. In the same manner aperture 106 is displaced from and of a smaller diameter than aperture 96 resulting in the third grip ring 108. Finally, entry aperture 34 is displaced from and of a smaller diameter than aperture 106 providing fourth grip ring 110. It is evident from FIG. 11 that the diameters of grip rings 88, 98, 108 and 110 decrease in the same manner as the step rings 80, 90 and 100 from left to right in FIG. 11 and provide access to the interior of boot 24 while providing seals for conductors of the diameters equal to or larger than the respective grip rings. For example, a conductor having a diameter somewhat larger than grip ring 108 can be installed by pushing the conductor straight into aperture 32 or by twisting the boot 24 while advancing it onto the cable 18. The grip ring 98 will stretch to accommodate cables 18 of a diameter larger than grip ring 108 depending upon the material from which boot 24 is fabricated and the size and shape of the grip ring 108. However, if the grip rings are stretched beyond their modulus of elasticity they will permanently distort and tear rendering the grip rings useless as seals. The amount of friction between the grip rings and the cable jacket makes installation of the boot 24 on cable 18 more difficult.

In addition to stretching grip ring 108, it is also necessary to stretch grip ring 110 as well. As the cable diameter increases, a grip ring closer to aperture 78 is required and all of the grip rings of smaller diameter are stretched and contribute to the frictional forces which make installation of the boot 24 on cable 18 difficult.

It should also be appreciated that cable 18 must first be installed in boot 24 so that it extends beyond boot end 36. This is required so that the outer jacket can be removed to gain access to the individual conductors. Then the insulation is removed from each conductor to expose the central conductive member and the bared ends of each central conductor member must be fixed to its associated terminal screw of the receptacle. Finally, the cable 18 must be pulled back from the boot 24 until the receptacle is fully within the boot 24. The frictional forces developed between the cable jacket and boot 24 also make withdrawal of the cable 18 more difficult and can also cause destruction of the smaller grip rings.

Figure 9:
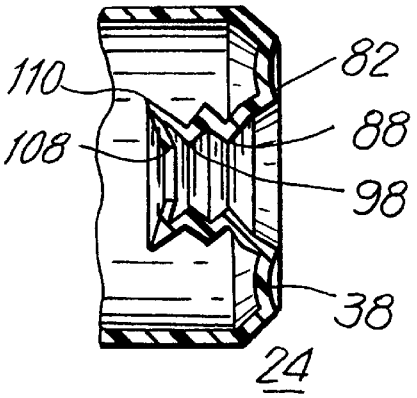
FIG. 9 is fragmentary, side elevational view, in section, of each of the boots of FIG. 1, with the stepped sealing means positioned in said boot.

A novel method has been discovered to make installation of the cable 18 within boot 24 and its subsequent partial withdrawal simplier, requiring less force, eliminating the destruction of grip rings and positioning the correct grip ring on the cable 18 to provide the desired environmental seal. A force is applied to the end face 104 of step 100 along the longitudinal axis in the direction of end 36. The effect of this is to reverse the grip rings so that ring 88 is adjacent rear surface 38 of the boot 24 as shown in FIG. 9. Then following right to left in FIG. 9, there are grip rings 98, 108 and 110. Also the diameters of grip rings 88, 98 and 108 assume generally equal diameters and grip ring 110 is stretched larger than the others. The cable can now be introduced into boot 24 which is rotated to decrease any frictional forces created.

The jacket of cable 18 can now be removed and the individual conductors bared and the receptacle (not shown) installed to the bared conductor ends. The cable 18 may now be withdrawn from boot 24 to position the receptacle within the boot 24. The result of the cable 18 withdrawal is to pull the stepped sealing means 32 out of boot 24 and restore the step rings to their former locations with certain of them distorted to produce the desired seals.

Figure 10:
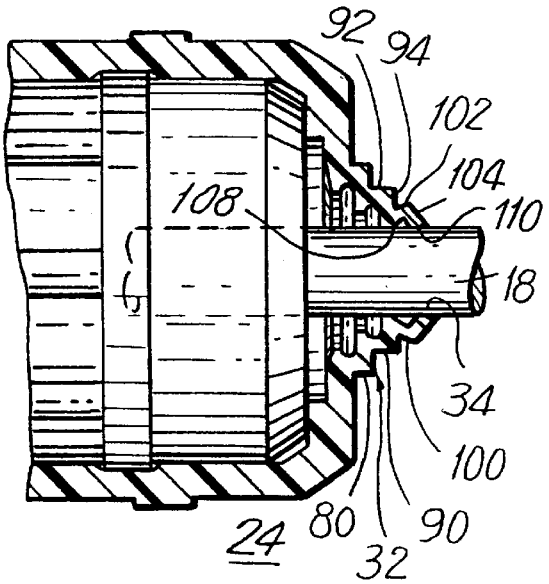
FIG. 10 is a fragmentary side elevational view, in section, of the seal between the boot and an inserted conductor.
Figure 11:
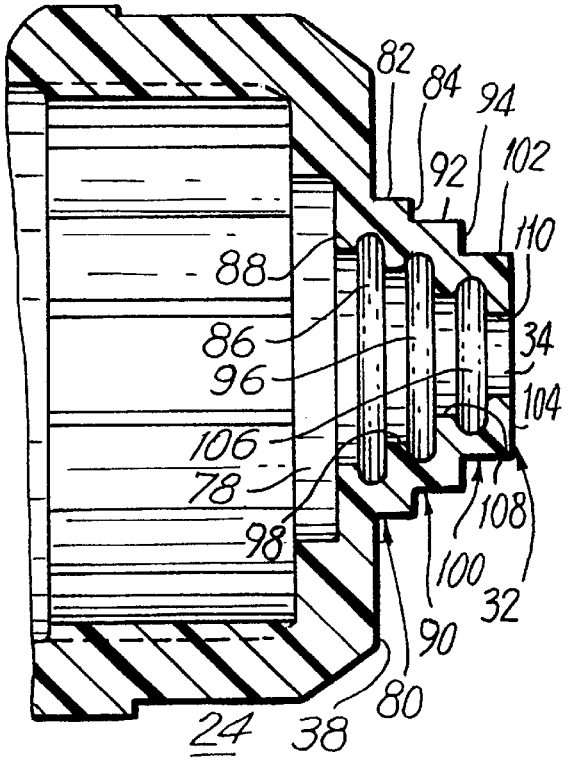
FIG. 11 is a fragmentary and enlarged side elevational view, in section, of the stepped sealing means of FIG. 3.

As shown by FIG. 10 grip ring 108 will be slightly stretched by cable 18 to provide an inner seal of the cable entrance into the boot 24. The grip ring 110 is also made to contact the cable 18 exterior and provide an outer seal. To accomplish this, the grip ring 110 inner diameter has been increased and riser 102 and tread 104 have been displaced from their respective positions parallel with and perpendicular to the longitudinal axis of boot 24. The grip rings 110 and 108 will provide the desired environmental seals for the cable entrance to boot 24. If the diameter of the cable 18 is increased more of the grip rings will be stretched and more of the steps displaced to accommodate such larger diameter cable.

While there have been shown and described and pointed out the fundamental novel features of the inventions as applied to the preferred embodiments, it will be understood that various omissions and substitutions and changes of the form and details of the devices illustrated and in their operation may be made by those skilled in the art, without departing for the spirit of the invention.

The embodiments of the invention in which an exclusive property or privilege is claimed are defined as follows:

What is claimed is:

1. An environmental seal assembly for protecting electrical plug and receptacles or the like, comprising, in combination:

a) a first boot formed about a substantially central longitudinal axis of substantially resilient material;

b) said first boot having an open first end and a substantially closed second end with a first cavity therebetween for housing a plug assembly or the like in said first cavity, said first boot having an exterior surface;

c) said first boot being further formed with a first inwardly inclined scouring and sealing surface on said exterior surface of said first boot adjacent said open first end of said first boot;

d) said first boot being yet further formed with a substantially annular exterior surface formed with a plurality of scalloped recesses which extend in directions substantially parallel with respect to said longitudinal axis, thereby forming a first gripping surface for accommodating the fingers of a user to permit said first boot to be moved in directions substantially parallel with said longitudinal axis and turned about said longitudinal axis;

e) a second boot formed about a substantially central longitudinal axis of substantially resilient material;

f) said second boot having an open first end and a substantially closed second end with a second cavity therebetween for housing a receptacle assembly or the like in said second cavity, a wall defining said second cavity having an interior surface;

g) said second boot being further formed with a first outwardly inclined scouring and sealing surface on said interior surface of said second boot adjacent said open first end of said second boot;

h) said second boot being yet further formed with a substantially annular exterior surface formed with a plurality of scalloped recesses which extend in directions substantially parallel with respect to said longitudinal axis, thereby forming a second gripping surface for accommodating the fingers of a user to permit said second boot to be moved in directions substantially parallel with said longitudinal axis and turned about said longitudinal axis;

i) at least one annular recess formed in said interior surface of said second boot adjacent said first open end;

j) said inwardly inclined surface of said first boot and said outwardly inclined surface of said second boot scouring one another upon joinder of said first boot with said second boot and depositing any moisture or debris found on said inwardly or outwardly inclined surfaces in said at least one annular recess.

2. An environmental seal assembly, as defined in claim 1, wherein said at least one annular recess is two recesses.

3. An environmental seal assembly, as defined in claim 1, wherein said inwardly inclined scouring and sealing surface is on a flexible annular rib which permits said inwardly inclined surface to travel along said outwardly inclined surface as said first and second boots are joined.

4. An environmental seal assembly, as defined in claim 1, wherein said first boot is formed with an inwardly facing scouring and sealing surface adjacent said inwardly inclined scouring and sealing surface to engage and be engaged by said outwardly inclined scouring and sealing surface as said first and second boots are joined.

* * * * *